United States Patent [19]

McKee

[11] 4,378,140

[45] Mar. 29, 1983

[54] ELECTRICAL CORD-RETAINING APPARATUS

[76] Inventor: Richard W. McKee, 1095 Hillcrest, Apt. A, Laguna Beach, Calif. 92651

[21] Appl. No.: 93,290

[22] Filed: Nov. 13, 1979

[51] Int. Cl.[3] ..... H01R 13/58

[52] U.S. Cl. ..... 339/119 C; 339/75 P; 339/103 R

[58] Field of Search ..... 339/37, 39, 75 P, 91 R, 339/119 C, 103 R, 104

[56] References Cited

U.S. PATENT DOCUMENTS

| | | | |
|---|---|---|---|
| 3,811,104 | 5/1974 | Caldwell | 339/75 P X |
| 3,838,383 | 9/1974 | Wilbur | 339/75 P |
| 3,960,432 | 6/1976 | Wilbur | 339/75 P |
| 4,045,108 | 8/1977 | Olsen | 339/75 P |

*Primary Examiner*—Eugene F. Desmond

[57] ABSTRACT

An apparatus for preventing the inadvertent disconnection of an electrical connector or plug inserted into a corresponding wall receptacle. The apparatus is comprised of a channel-shaped cord retention member (40) connected with two threaded fasteners (48) and (52) to an attaching member (12). The attaching member (12) is basically formed of resilient material (16) and contains a grooved rod (24) that protrudes beyond the bottom surface of the attaching member (12). A wall plate-receiving member (64) is provided with a slotted opening (68) through which the grooved rod (24) penetrates when pressure is exerted on the resilient material (16). The compression force maintains contact with the attaching member (12) and the wall plate (64). An electric cord is positioned between the cord retention member (40) and the attaching member (12) by compression of the two threaded fasteners (48) and (52).

1 Claim, 10 Drawing Figures

ELECTRICAL CORD-RETAINING APPARATUS

TECHNICAL FIELD

The invention relates to safety devices for preventing the inadvertent disconnection of an electrical connector or plug inserted into a corresponding wall receptacle. More specifically, the invention encompasses devices that are attached to the plate of a wall receptacle and are equipped with fastening means to retain the electrical cord attached to the connector or plug inserted into the wall receptacle

BACKGROUND ART

Previously, there have been numerous devices developed to retain electrical apparatus with cords and plugs; however they have, in most cases, been limited to securing the plug only as a method of retention. U.S. Pat. No. 3,067,402 issued to Thaw teaches such an arrangement with a separate attachment fastened with a screw to secure an electrical plug in a female opening. Further, Caldwell, in U.S. Pat. No. 3,811,104, discloses a separate bracket attached to the wall plate screw that retains the back side of the plug. U.S. Pat. No. 3,656,083 issued to Brook provides for a rotating cover with an oval opening that, when rotatably positioned, retains the plug in place by restricting the corners of the plug. Likewise, Wasserman, in U.S. Pat. No. 3,955,870, utilizes a rotating cover to enclose the plug. U.S. Pat. No. 3,281,758, issued to Appleton, uses a mechanical locking device to retain the edges of a nonstandard plug when inserted into the receptacle and an external locking device. Other methods have been utilized to attempt to solve the problem: Boatwright, U.S. Pat. No. 3,749,815, and Kehaut, U.S. Pat. No. 3,972,579, both teach a method of retaining a cord; however in both cases, the device is a rubber grommet which is not primarily intended for stress relief or retention other than mere isolation from a round hole. This approach does not supply the cord-retaining properties of the present invention. Also, both of the disclosures are used for flush boxes with the plug inside being virtually unsupported. Further, there are no provisions for a quick release or changing of cords.

For background purposes and as indicative of the art to which the invention relates, reference may be made to U.S. Pat. No. 4,040,698 issued to Ortiz and U.S. Pat. No. 3,345,600 issued to Scherer.

SUMMARY OF THE INVENTION

The invention provides a safety device that attaches an electrical cord near the plug to a receptacle providing a positive locking arrangement preventing accidental removal of the plug from the receptacle. Presently, conventional electrical plugs are inserted into receptacles and are retained by friction to create an electrical contact and maintain physical position. With this arrangement, the plug may unknowingly be detached by remotely pulling on the cord or accidentally kicking or bumping the plug with an object. This can be detrimental to the electrical apparatus that has no visual indication of operation, such as medical life-sustaining equipment, a refrigerator, or a freezer that may damage the contents if inadvertently disconnected. Also, disruption of power is inconvenient for items such as clocks that require continuous power for normal operation. The need for a simple, convenient method of safely retaining a cord or plug to a receptacle has long been present.

The primary objects of the invention are to provide a device that (1) is adaptable to most conventional electrical cords used for powering electrical apparatus; (2) is easily and quickly installed or removed from the wall plate without any tools or special fittings, and (3) securely holds the electrical cord from external movement.

Another object is to have an invention that requires no special tools or modification to the plug, such as twisting devices, external connectors, fasteners, and the like.

An important further object of the invention is to prevent tampering with the plug by children and to prevent bending of the prongs of conventional blade-type plugs when the cord is pulled at an angle.

Another object is to prevent slipping of the plug from the receptacle if excessive tension is placed on the cord.

These and other objects and advantages of the present invention will become apparent from the subsequent detailed description and claims taken in conjunction with the accompanying drawings.

DESCRIPTION OF THE PREFERRED EMBODIMENT

Figure 1:
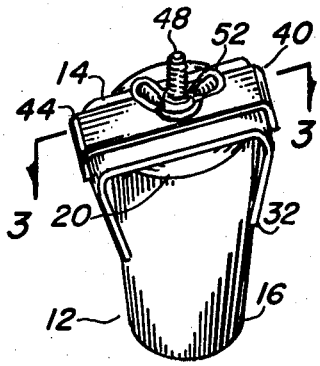
FIG. 1 is a partial isometric view of the preferred embodiment.
Figure 2:
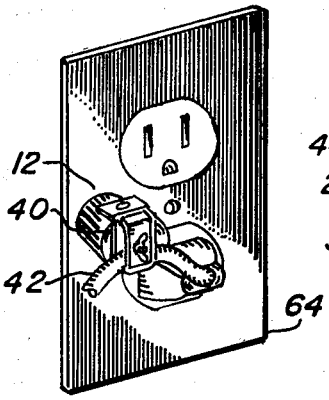
FIG. 2 is a partial isometric view of the embodiment including a wall plate and a duplex receptable with a cord and plug.

The best mode or preferred embodiment is shown in FIG. 1. This FIGURE depicts an embodiment consisting of two basic parts, the attaching member 12 and the cord retention member 14. The first member 12 consists of a tapered or parallel cylindrical compressible resilient plug 16. This plug may also be in rectangular or oval configuration and further contains a penetration 18 located centrally from the top surface 20 to the bottom surface 22. The penetration 18 is round in shape, and a grooved attaching rod 24 is pressed into the penetration 18 being somewhat smaller in diameter making an interference fit securely retaining the rod 24. The attaching rod 24 is cylindrical in shape with a flat head 26 upset at one end. The head is preferably countersunk with a flat or round shape also being acceptable. The head 26 is slightly recessed at 28 into the plug 16 providing electrical isolation from other parts of the assembly. The end of the rod 24 opposite the head 26 is rounded, beveled or coned in shape with the recessed groove 30 located adjacent to the shaped end. The groove 30 extends to be flush with the bottom surface 22 of the plug when compressed. The material of the plug may be any resilient substance with the properties of compressability and memory of its original shape. Natural rubber, plastic, viton, or buna compounds may be used; however synthetic rubber such as neoprene is preferred. An enclosing bracket 32, in at least channel shape, encompasses the top surface 20 of the plug 16. The web of the channel-shaped bracket 32 embraces the plug top surface 20, and the legs of the bracket are parallel with the sides of the plug 16. A channel shape is preferred; however a fully encompassing bracket may be utilized in a round or rectangular configuration, either working equally well. The bracket 32 is connected to the plug 16 with fastening means 34 preferably in the form of blind drive rivets; however structural adhesive, welding threaded fasteners and the like may be utilized with equal integrity.

Figure 3:
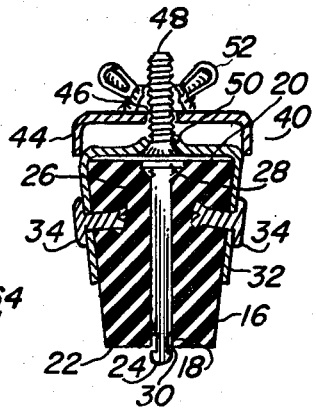
FIG. 3 is a sectional view of the preferred embodiment taking along the line 3—3 of FIG. 1.
Figure 7:
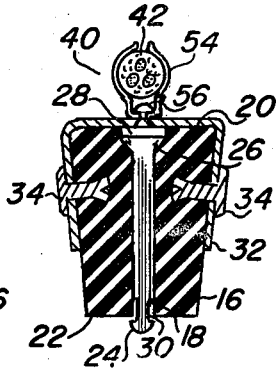
FIG. 7 is a cross-sectional view of an embodiment of the invention with spring-loaded cord-retaining means.

Cord retention member 40 firmly grasps and retains an electrical cord 42 preventing accidental movement that may disconnect the attached plug. The preferred embodiment is shown in FIG. 3 with the cord engaging clamp 44 in channel shape with a hole 46 in the center of the web. A threaded fastener 48, such as a screw is located in the hole 50 in the top surface of the bracket 32 and protrudes through the holes 46 in the channel 44. A threaded retainer 52, such as a wing nut is attached to the fastener 48 applying pressure between the channel 44 and bracket 32 making a firm attachment to the cord 42. Another embodiment of the retention member 40 is depicted in FIG. 7 and utilizes a spring clip 54 as the retention means. The clip 54 is in the form of an open-ended loop with a flat portion in the center. The loop is shaped to retain the electrical cord with the end pried open for insertion. The spring tension provides constant pressure on the cord, and a coating of resilient material may be deposited on the surface to prevent electrical contact with the cord if the spring is metallic. The material of the spring clip 54 is preferably metallic, such as spring steel; however some form of plastic with spring characteristics may be utilized. The clip 54 is attached to the bracket 32 with fastening means 56, such as a rivet, or may be permanently spot-welded or adhesive-bonded.

Figure 10:
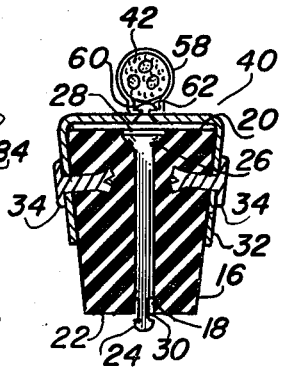
FIG. 10 is a cross-sectional view of an embodiment of the invention with permanent cord-fastening means.

Yet another embodiment of the retention member 40 is shown in FIG. 10 wherein a ring tab 58 is provided integral with the electrical cord 42 and is bonded or molded into the cord jacket. This ring 58 provides a flat surface with the hole 60 in the center to which the cord is attached by fastening means 62 to the bracket 32 directly. The fastening means 62 may be a threaded fastener, cap or stud; however a rivet is preferred. This method of retaining the apparatus is permanent, inasmuch as the device is provided with a cord and is not intended to be removed.

Figure 6:
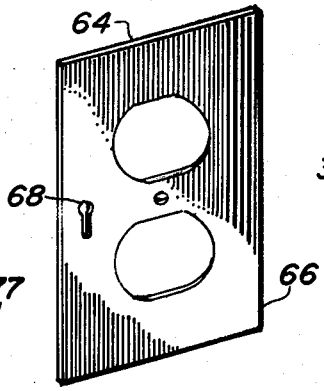
FIG. 6 is a partial isometric view of a wall plate with slotted retaining means.

The apparatus further incorporates the use of a wall plate-receiving member 64. The preferred embodiment is shown in FIG. 6 with a wall plate 66 of the configuration to replace existing plates in the field being completely interchangeable with most types of single, duplex and combination plates. The plate 66 is in the state-of-the art configuration, except a slotted opening 68 is located adjacent to the electrical receptacles. The slotted opening 68 contains a slot with one end enlarged to receive the grooved attaching rod 24. This opening provides sufficient clearance, allowing the rounded end of the rod 24 to penetrate the enlarged slot, and the remainder is slightly wider than the recessed groove 30 in the rod 24, thus retaining the rod at the head when slid completely in the slot. The slotted opening 68 receives the groove-attaching rod 24 when the attaching member 12 is juxtapositioned with the wall plate-receiving member 66. As pressure is applied to the resilient plug 16, the rod 24 is extended and positioned in the slot 68 and engaged at the smaller end when pressure is released. The member 12 is then firmly locked into place with the compression of the material 16, placing the bottom of the groove 30 on the rod 24 into intimate contact with the plate 66, making a positive attachment.

Figure 4:
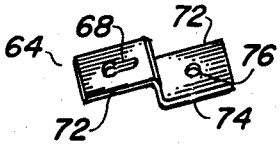
FIG. 4 is a partial isometric view of an offset angle retainer bracket.

Another embodiment of the wall plate-receiving member 64 is pictorially described in FIG. 4. The member 64 is in a parallel offset shape with two flat surfaces 72 and 74. The flat surface 74 contains an opening 76 for attaching with a screw to a state-of-the art wall plate. The attachment may be either top or bottom in a single outlet or between the outlets on a duplex type wall plate. The other flat surface 72 has a slotted opening 68, as previously described.

Figure 5:
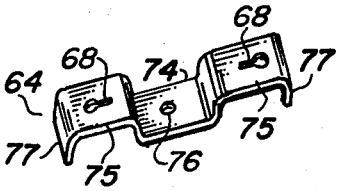
FIG. 5 is a partial isometric view of a hat-shaped retainer bracket.

Yet another embodiment of the wall plate-receiving member 64 is shown in FIG. 5. The member 64 is similar to FIG. 4, except that there are two opposed flat surfaces 75 along with surface 74, each containing a slotted opening 68. If desired, a flange 77 is located on each end angular to the surface 75 and parallel to the underside of the surface 74.

Figure 8:
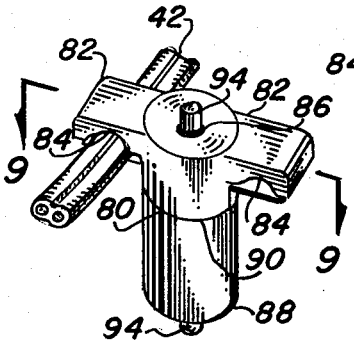
FIG. 8 is a partial isometric view of an embodiment of the invention with a compression spring.
Figure 9:
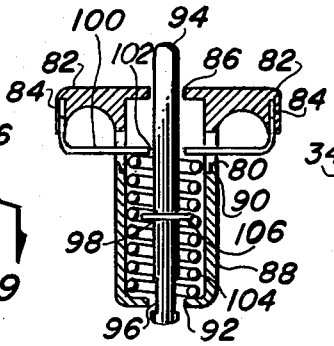
FIG. 9 is a sectional view of an embodiment taken along the line 9—9 of FIG. 8.

FIG. 8 depicts another embodiment of the electrical cord-retaining apparatus. This embodiment utilizes the same principles, yet a compression spring provides the tensioning force necessary to hold both the retaining pin and the electrical cord. A top housing 80 circular in shape contains a pair of arms 82 extending angularly from the top surface. The arms 82 are flat on the top with a curved surface on the opposed side with a recess 84 located adjacent to the curved surface. The inside of the housing 80 contains a cavity with a round opening 86 in the center. A bottom housing 88 interfaces with the top housing 80 through a register 90, preferably the top male, and the bottom female. The bottom housing 88 is cylindrical in shape with a cavity in the center and a round bottom opening 92 centrally located. A grooved attaching rod 94 is located in the center of the housing assembly penetrating the top opening 86 and the bottom opening 92. The rod 94 further contains a recessed groove 96 near the bottom and a snap ring slot 98 located approximately one-third the length from the bottom. Both ends of the rod 94 are beveled.

A retaining arm 100, in channel shape, contains a centrally located round hole 102 in the web. The legs of the channel-shaped arm 100 are extended to interface with the top housing arm 82 and enter the recess 84, creating a pocket between the housing arm 82 and the retaining arm 100. The rod 94 penetrates the hole in the arm allowing the arm 100 to move freely, enlarging or decreasing the size of the pocket. This slidable connection allows an electrical cord of different sizes to be retained. As the arm 100 is floating on the rod 94, one cord may be retained independently. A compression spring 104 is located in the cavity of the housing assemblies 80 and 88 and surrounds the attaching rod 94. The spring 104 presses on the bottom of the cavity and the retaining arm 100 forcing the arm upward to grasp a cord placed in the aforementioned pocket. This opposed pressure creates the force necessary to retain the cord.

A snap ring 106 is connected to the rod 94 in a snap ring slot 98, which separates the spring and allows tension to be transmitted to the cord-attaching pocket and also forces the rod upward independently, allowing the groove 96 to be normally located within the housing 88. In operation, the rod 94 is manually depressed from the top, subsequently compressing the spring 104. The arm 100 is also moved under further spring tension to allow a cord to be positioned in the pocket between the arm 100 and the housing 82. After the cord is in place, the rod 94 is similarly depressed, and the groove 96 is exposed beneath the housing 88. The apparatus is then placed over one of the previously described wall plate-receiving members, as shown in FIGS. 4, 5 and 6. The rod 94 penetrates the slotted openings 68, and the groove 96 tightly grasps the undersurface when the external pressure is released. The spring tension retains the apparatus in place, and the cord is secured by the same tension.

While the invention has been described in complete detail and pictorially shown in the accompanying drawings, it is not to be limited to such detail. Since many changes and modifications may be in the invention without departing from the spirit and scope thereof, it is described to cover any and all modifications and forms which may come within the language and scope of the claims.

I claim:

1. An electrical plug connector retaining apparatus comprising:

(a) a top housing having a plurality of angular extending arms, a top opening, and side slots;

(b) a bottom housing having a cavity and a bottom opening attached to said top housing forming a housing assembly;

(c) a grooved attaching rod with a snap ring slot penetrating said housing assembly through both top and bottom openings;

(d) a channel-shaped retaining arm surrounding said grooved attaching rod having angular legs extended to interface with said top housing arms providing a slideable opening therebetween to accept and retain an electric cord;

(e) a compression spring located in said housing assembly cavity surrounding said grooved attaching rod, maintaining opposed pressure on said retaining arm and housing;

(f) a snap ring positioned on said slot urgingly forcing said retaining arm against said housing arms and simultaneously maintaining the groove in said attaching rod above said housing bottom opening, and when said retaining arm is manually depressed from said top opening of said top housing said spring is compressed allowing said groove to be extended below said housing bottom opening; and (g) a wall plate-receiving member having a slotted opening, accepts said depressed grooved attaching rod into said slotted opening and when released maintains constant tension providing attaching means.

* * * * *